US011688977B2

(12) United States Patent
Shettar et al.

(10) Patent No.: US 11,688,977 B2
(45) Date of Patent: Jun. 27, 2023

(54) CONNECTOR LEVER WITH WIRE GUIDE

(71) Applicants: TE Connectivity Services GmbH, Schaffhausen (CH); TE Connectivity India Private Limited, Bangalore (IN)

(72) Inventors: Vinayakumar Shettar, Bangalore (IN); Ramesh S, Bangalore (IN); Stephen J. Descioli, Louisville, KY (US); Melani Cindric, Middletown, PA (US); Richard T. Shell, Prospect, KY (US)

(73) Assignees: TE Connectivity Solutions GmbH, Schaffhausen (CH); TE Connectivity India Private Limited, Bangalore (IN)

( * ) Notice: Subject to any disclaimer, the term of this patent is extended or adjusted under 35 U.S.C. 154(b) by 94 days.

(21) Appl. No.: 17/498,057

(22) Filed: Oct. 11, 2021

(65) Prior Publication Data

US 2023/0057164 A1 Feb. 23, 2023

(30) Foreign Application Priority Data

Aug. 19, 2021 (IN) ..... 202141037654

(51) Int. Cl.

| | |
|---|---|
| ***H01R 13/629*** | (2006.01) |
| ***H01R 13/58*** | (2006.01) |
| ***H01R 13/516*** | (2006.01) |
| ***H01R 13/639*** | (2006.01) |

(52) U.S. Cl.

CPC ..... *H01R 13/62938* (2013.01); *H01R 13/516* (2013.01); *H01R 13/58* (2013.01); *H01R 13/62955* (2013.01); *H01R 13/639* (2013.01)

(58) Field of Classification Search

CPC .... H01R 13/58; H01R 13/639; H01R 13/516; H01R 13/62938

See application file for complete search history.

(56) References Cited

U.S. PATENT DOCUMENTS 4,541,679 A * 9/1985 Fiedler ..... H01R 4/2412 439/864

7,618,271 B2 * 11/2009 Shiga ..... H01R 13/62977 439/157

FOREIGN PATENT DOCUMENTS

EP 0271413 A1 * 6/1988 ..... H01R 12/675

* cited by examiner

*Primary Examiner* — Briggitte R. Hammond

(57) ABSTRACT

An electrical connector having a connector housing and a lever. The connector housing has a first wall, a second wall and side walls which extend between the first wall and the second wall. Multiple contacts are positioned in contact receiving cavities of the housing. The multiple contacts have wires which extend therefrom. A lever is rotatably mounted relative to the connector housing. The lever has lever arms and a lever handle. The lever arms extend from the side walls of the housing and the lever handle extends between the lever arms. A wire guide is positioned on the lever. The lever is rotatable between a pre-insertion position and an insertion position. When the lever is in the insertion position, the wire guide engages the wires which extend from the housing to direct the wires to a designated position.

20 Claims, 5 Drawing Sheets

CONNECTOR LEVER WITH WIRE GUIDE

FIELD OF THE INVENTION

The present invention relates to a lever for an electrical connector which provides mechanical assist in mating and functions as a wire guide cover.

BACKGROUND OF THE INVENTION

Connector assemblies may have a plug connector, a mating connector, and an actuation means for moving one of the connectors into engagement with the other connector such that receptacle contacts of the plug connector are electrically connected to pluggable contacts of the mating connector. These types of arrangements are primarily used in applications having high pin counts and low engagement force is needed.

In order to save space, the plug connector is formed so that only a small portion of the plug connector projects from the mating connector when the connectors are engaged. This configuration causes the disengagement of the plug connector from the mating connector to be difficult. A problem also exists in that the plug connector arrangement has a large number of contact elements that exert a high normal contact force such that considerable force is required to plug-in and release the plug connector from the mating connector.

In order to resolve these problems, various connector arrangements have been provided with levers which camming members. For example, the levers may be provided on receptacle connectors. Movement of a plug connector toward the receptacle connector can be facilitated by the rotation of the lever with respect to the direction of the movement of the plug connector toward the mating connector.

While the conventional connector levers may provide a mechanical assists to reduce mating force, the levers do not facilitate or guide the wires extending from the plug connector to a desired position relative to the plug connector and the connector assembly. Separate wire guide covers are required to guide the wires to the desired location based on the customer application. As both the lever and the wire guide are separate and distinct parts, the cost and assembly time of the connector is increased.

It is therefore desirable to develop a lever for use with a plug connector which includes a wire guide to provide the mechanical assist needed for mating and properly position the wires in the desired location.

SUMMARY OF THE INVENTION

An embodiment is directed to an electrical connector having a connector housing and a lever. The connector housing has a first wall, a second wall and side walls which extend between the first wall and the second wall. Multiple contacts are positioned in one or more contact receiving cavities of the connector housing. One or more of the multiple contacts have wires which extend therefrom. A lever is rotatably mounted relative to the connector housing. The lever has lever arms and a lever handle. The lever arms extend from the side walls of the housing and the lever handle extends between the lever arms. A wire guide is positioned on the lever. The lever is rotatable between a pre-insertion position and an insertion position. When the lever is in the insertion position, the wire guide engages the wires which extend from the housing to direct the wires to a designated position.

An embodiment is directed to an electrical connector having a connector housing with a first wall, a second wall and side walls extending between the first wall and the second wall. Multiple contacts are positioned in one or more contact receiving cavities of the connector housing, one or more of the multiple contacts have wires which extend therefrom. Lever engaging projections extending from the side walls. A lever is rotatably mounted relative to the connector housing. The lever has lever arms and a lever handle. The lever arms extend from the side walls of the housing and the lever handle extends between the lever arms. The lever arms having projection receiving openings which engage the lever engaging projections. A wire guide is positioned on the lever. The wire guide has a wire engaging surface. As the lever is rotated about the lever engaging projections between a pre-insertion position and an insertion position, the wire engaging surface of the wire guide engages the wires which extend from the housing to direct the wires to a designated position.

An embodiment is directed to an electrical connector having a connector housing with a first wall, a second wall and side walls which extend between the first wall and the second wall. Multiple contacts are positioned in one or more contact receiving cavities of the connector housing. One or more of the multiple contacts have wires which extend therefrom. A one piece lever and wire guide member is mounted to the housing. A lever portion of the one piece lever and wire guide member is rotatably mounted relative to the connector housing. The lever portion has lever arms and a lever handle. The lever arms extends from the side walls of the housing. The lever handle extends between the lever arms. A wire guide portion of the one piece lever and wire guide member is positioned on the lever portion. The wire guide portion has a wire engaging surface. As the one piece lever and wire guide member is rotated between a pre-insertion position and an insertion position, the wire engaging surface of the wire guide portion engages the wires which extend from the housing to direct the wires to a designated position.

Other features and advantages of the present invention will be apparent from the following more detailed description of the illustrative embodiment, taken in conjunction with the accompanying drawings which illustrate, by way of example, the principles of the invention.

DETAILED DESCRIPTION OF THE INVENTION

Figure 1:
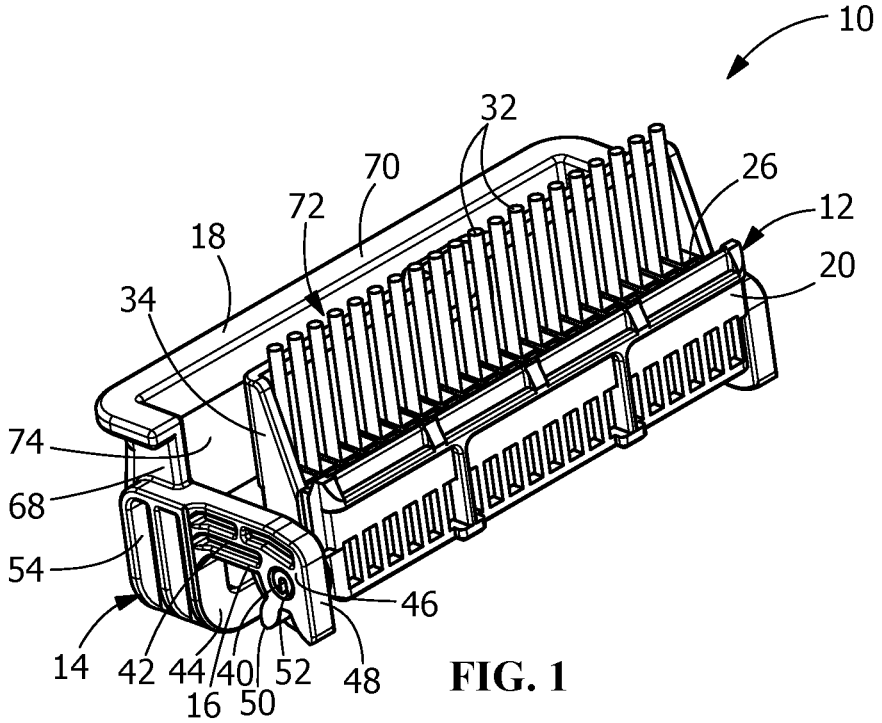
FIG. 1 is a perspective view of an illustrative connector according to the present invention, for ease of viewing only a few terminals and wires are positioned in the housing of the connector, the lever is shown in a first or pre-insertion position.
Figure 2:
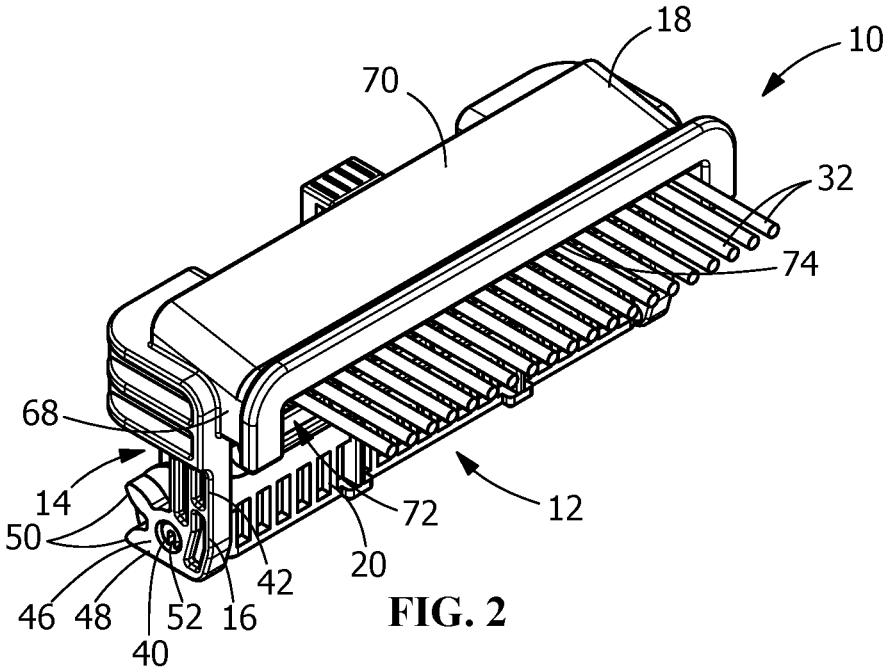
FIG. 2 is a perspective view of an the connector of FIG. 1 with the lever shown in a second or insertion position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIGS. 1-4, an illustrative embodiment of a plug connector 10 includes a plug housing 12 and a lever and wire guide member 14. The lever and wire guide member 14 is pivotably or rotatably mounted to the plug housing 12. The lever and wire guide member 14 has a lever member or portion 16 and a wire guide member or portion 18. In an embodiment, the lever member or portion 16 and the wire guide member or portion 18 are integrated. In another embodiment, the portion 16 and the portion 18 are manufactured as a single piece. The lever and wire guide member 14 that includes the combination of the portion 16 and the portion 18 provides a mechanically assist for the mating of the plug connector 10 and functions as a wire guide, as will be more fully described.

Figure 4:
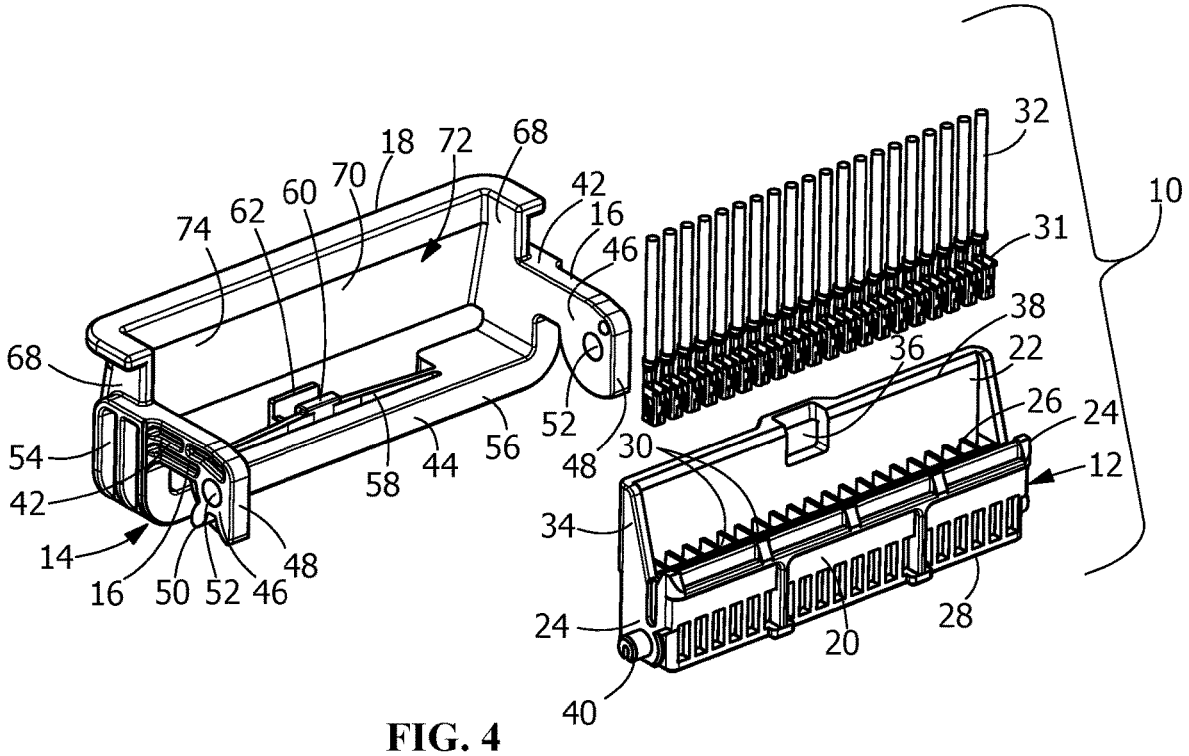
FIG. 4 is a perspective view of the connector housing of FIG. 1, with the lever and wire guide exploded therefrom.

As shown in FIG. 4, the plug housing 12 includes a front or first wall 20, a rear or second wall 22, and side walls 24. A wire receiving face 26 and an oppositely facing mating face 28 each extend between the first wall 20 and the second wall 22, and between the side walls 24. A plurality of contact or terminal receiving cavities 30 extend between the wire receiving face 26 and the mating face 28. The contact receiving cavities 30 are configured to house terminals 31 therein. Wires 32, which are in electrical engagement with the terminals 31, extend from the one or more of the contact receiving cavities 30 at the wire receiving face 26 of the plug housing 12.

In the illustrative embodiment shown, the second wall 22 extends from the mating face 28 beyond the wire receiving face 26. Portions 34 of the side walls 24 also extend beyond the wire receiving face 26. The second wall 22 has a locking opening 36. The locking opening 36 is positioned proximate the longitudinal center of the second wall 22 and proximate a free end 38 of the second wall 22. However, other positioning and configurations of the locking opening 36 may be used.

Lever engaging projections 40 project outward from the side walls 24. In the illustrative embodiment shown, the lever engaging projections 40 are stub shafts with a circular cross-sectional diameter. However, other types and configurations of lever engaging projections 40 may be used.

As shown in FIG. 4, the lever member or portion 16 of the lever and wire guide member 14 has two lever arms 42. A lever handle 44 extends between the lever arms 42. Each lever arm 42 end has a rotary portion 46 provided at a free end 48. The rotary portions 46 include one or more pinion teeth 50. Projections receiving openings 52 are positioned at a central location of the rotary portion of 46 to be received over the lever engaging projections 40.

The lever handle 44 extends between the lever arms 42. The lever handle 44 has end portions 54 and an engagement portion 56. In the illustrative embodiment shown, the end portions 54 extend from the lever arms 42 in a direction which is essentially perpendicular to the longitudinal axis of the lever arms 42. However, in other embodiments, the end portions 54 may extend from the lever arms 42 at other angles, such as, but not limited to, forty-five degrees or sixty degrees. The engagement portion 56 of the lever handle 44 extends from the end portions 54 in a direction which is parallel to the longitudinal axis of the plug housing 12 of the plug connector 10. The engagement portion 56 is offset from the longitudinal axis of the lever arms 42.

Figure 3:
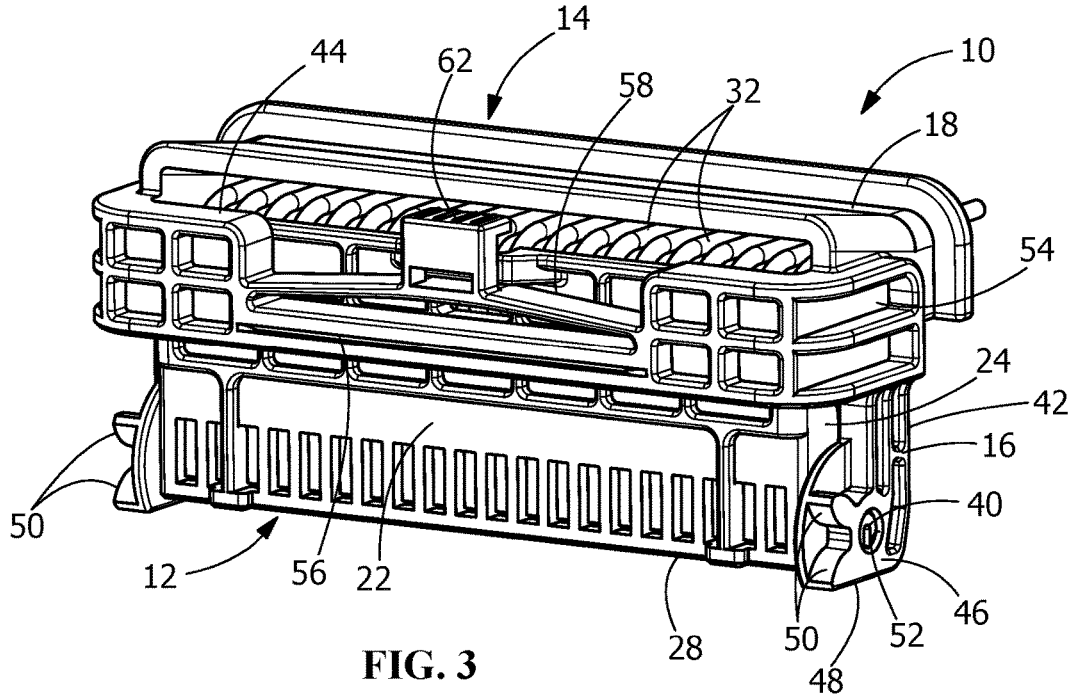
FIG. 3 is a back perspective view of an the connector of FIG. 2.
Figure 9:
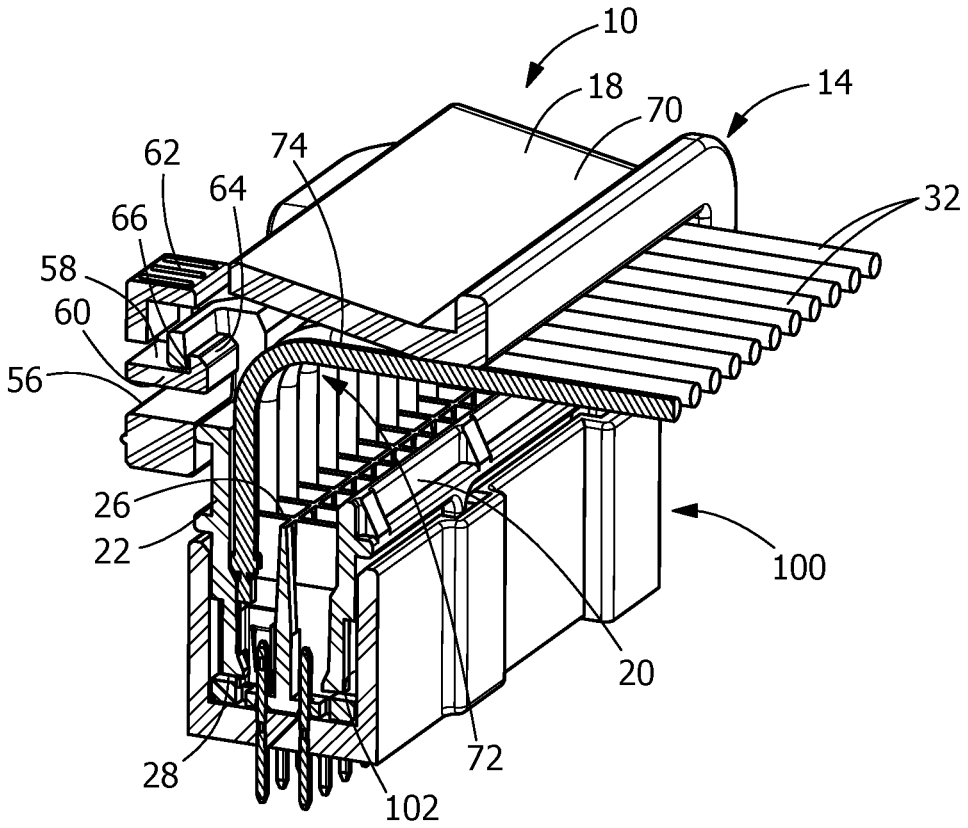
FIG. 9 is a cross-sectional view taken along line 9-9 of FIG. 7.

As shown in FIGS. 3, 4 and 9, a resilient locking arm 58 is provided on the lever handle 44. The resilient locking arm 58 has a latching or locking projection 60 and a release projection 62 which extend therefrom. The release projection 62 is in line with the locking projection 60. The locking projection has a lead-in surface 64 and a locking shoulder 66.

The wire guide member or portion 18 of the lever and wire guide member 14 has side walls 68 and a camming wall 70 which extends between the side walls 68. The side walls 68 are attached and extend from either or both of the end portions 54 of the lever handle 44 or the lever arms 42 of the lever member or portion 16. In various embodiments, the side walls 68 are attached to the end portions 54 of the lever handle 44 or the lever arms 42 integrally molded in one piece with the lever portion 16. Alternately, the side walls 68 may be attached to the end portions 54 of the lever handle 44 or the lever arms 42 by adhesive or other known attachment methods to form a single piece lever and wire guide member 14.

The side walls 68 and a camming wall 70 form a wire receiving cavity 72 which is dimensioned to receive portions of wires 32 therein. A wire engaging surface 74 is positioned on the camming wall 70 in the wire receiving cavity 72. The camming wall 70 and the wire engaging surface 74 extend in a direction which is parallel to the longitudinal axis of the housing 12 of the plug connector 10 and parallel to the longitudinal axis of the engagement portion 56 is offset from the longitudinal axis of the lever handle 44.

Figure 5:
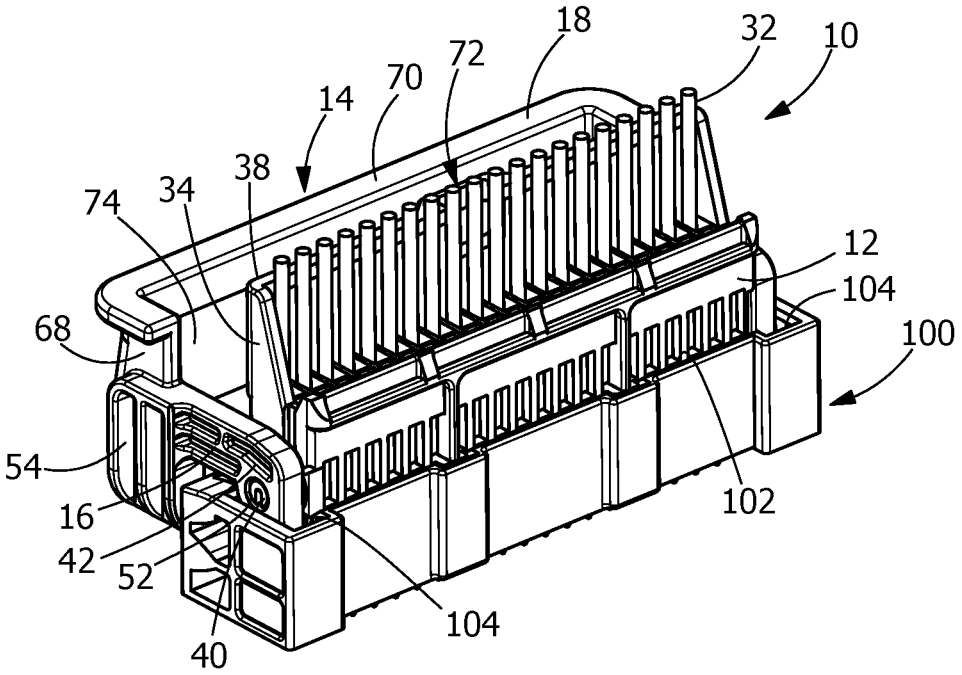
FIG. 5 is a perspective view of the connector of FIG. 1 partially inserted into a mating connector.

With the plug connector 10 properly assembled and with the lever and wire guide member 14 positioned in a pre-insertion or open position, e.g., as shown in FIG. 5, the plug connector 10 is positioned to be inserted into a connector receiving recess 102 of a mating connector 100. In this position, as shown in FIG. 6, the free ends 48 of the lever arms 42 are positioned in lever receiving recesses 104 of the mating connector 100.

Figure 6:
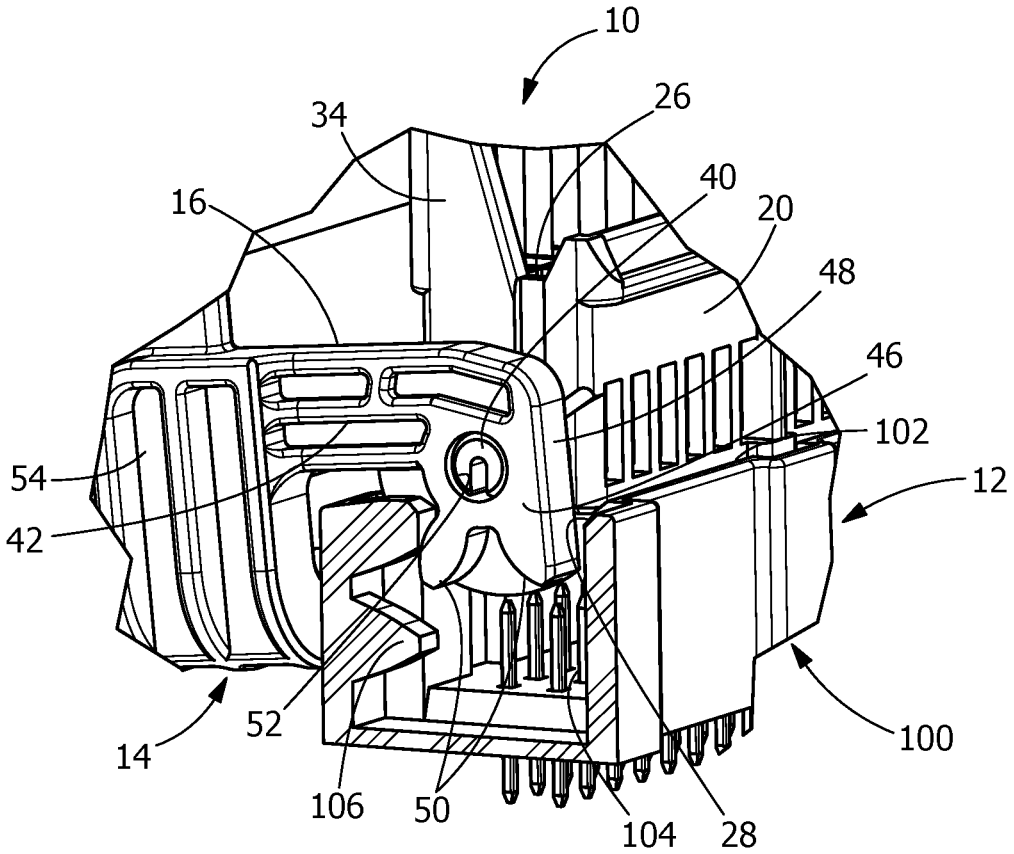
FIG. 6 is a cross-sectional view taken along line 6-6 of FIG. 5.
Figure 7:
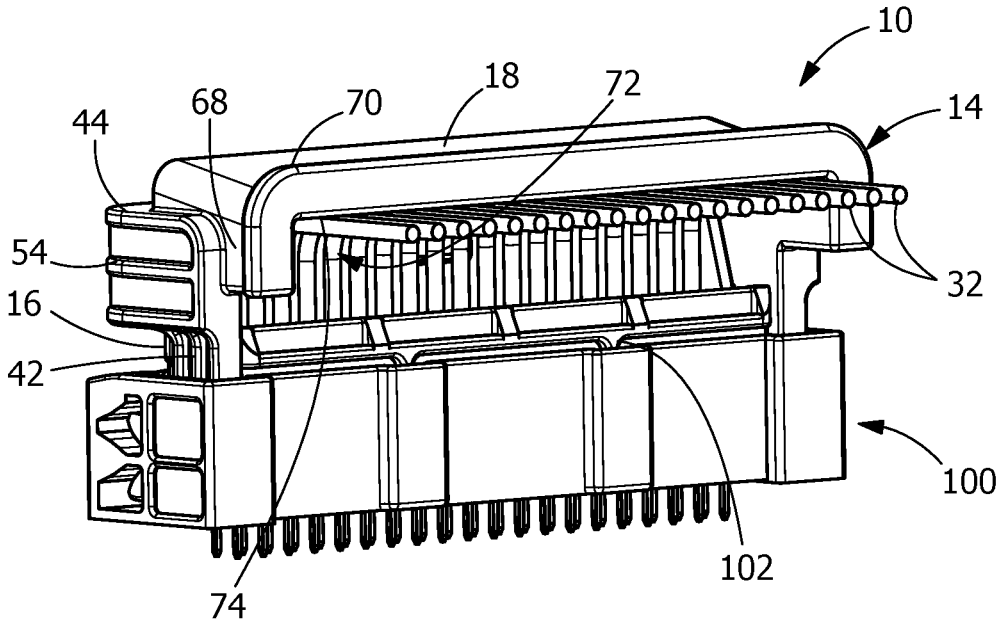
FIG. 7 is a perspective view similar to FIG. 6, showing the connector fully inserted into a mating connector.
Figure 8:
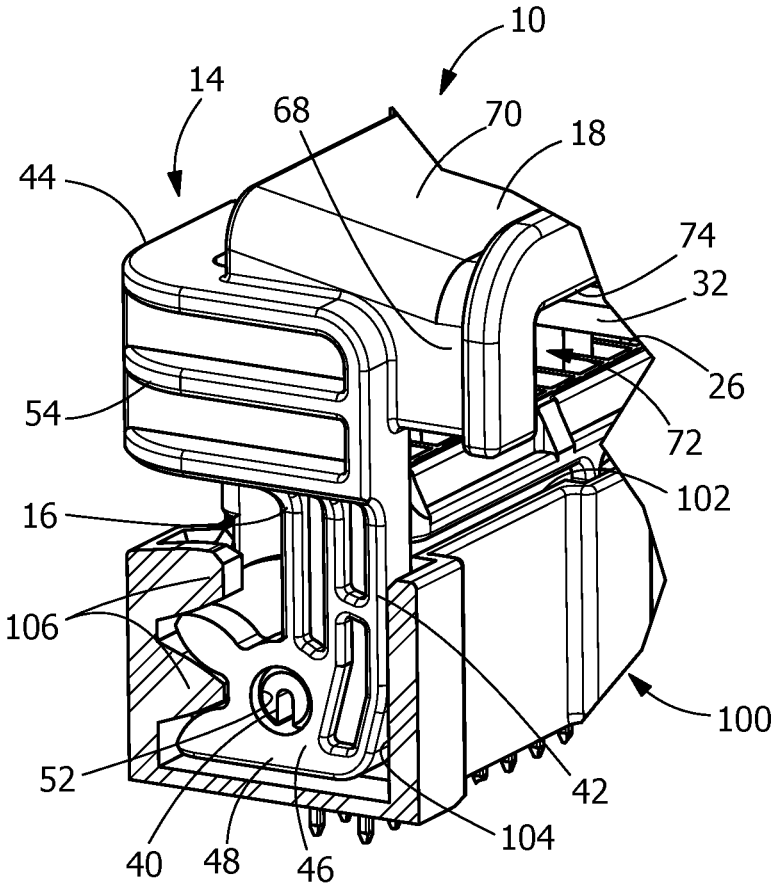
FIG. 8 is a cross-sectional view taken along line 8-8 of FIG. 7.

In order to fully insert the plug connector 10 into the connector receiving recess 102, the lever and wire guide member 14 is rotated from the pre-insertion or open position, as shown in FIGS. 5 and 6, to an insertion or closed position, e.g., as shown in FIGS. 7 and 8. As the lever and wire guide member 14 is rotated the pinion teeth 46 of the lever arms 44 engage teeth 106 of the mating connector 100. This causes the plug connector 10 to be drawn or forced into the connector receiving recess 102. As this occurs, the lever portion 16 of the lever and wire guide member 14 provides the mechanical assist needed to overcome the high mating force associated with the high number of terminals positioned in the plug connector 10 and the mating connector 100.

In addition, as the lever and wire guide member 14 is rotated from the pre-insertion or open position, shown in FIGS. 5 and 6, to the insertion or closed position as shown in FIGS. 7 and 8, the wire guide portion 18 of the lever and wire guide member 14 engage the wires 32 extending from the wire receiving face 26 of the plug connector 10. As rotation occurs, the wire receiving cavity 72 is moved over portions of the wires 32. As rotation continues, the wire engaging surface 74 of the camming wall 70 engages portions of the wires 32 to move the wires 32 to a designated position, to properly position the wires 32 in the desired location and orientation. In the designated position, the wires 32 may extend at ninety degrees, sixty degrees, forty-five degrees or other orientations from the wire receiving face 26 of the plug connector 10.

As the lever is moved to the insertion or closed position, the locking projection 60 on the resilient locking arm 58 of the lever handle 44 is moved into the locking opening 36 of the second wall 22. As this occurs, the lead-in surface 64 of the locking projection 60 engages the wall of the locking opening 36, causing the locking projection 60 to be deflected. Continued insertion allows the locking shoulder 66 of the locking projection 60 to be moved past the wall of the locking opening 36, allowing the resilient locking arm 58 to return the locking projection 60 toward its initial position. As shown in FIG. 9, in this position, the locking shoulder 36 engages the second wall 22, thereby preventing the unwanted movement of the lever and wire guide member 14 back toward the pre-insertion position.

In order to release the lever and wire guide member 14 from the insertion position, the release projection 62 is engaged, moving the resilient locking arm 58 to a stressed position. As this occurs, the locking shoulder 36 is disengaged from the second wall 22, allowing the locking projection 60 to be removed from the locking opening 36, and allowing the lever and wire guide member 14 to be moved from the insertion position to the pre-insertion position.

The integrated or single-piece configuration of the lever and wire guide member 14 as discussed herein reduces the investment for additional molds and reduces assembly times and costs.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector comprising:

a connector housing having a first wall, a second wall and side walls extending between the first wall and the second wall;

multiple contacts positioned in one or more contact receiving cavities of the connector housing, one or more of the multiple contacts having wires extending therefrom;

a lever rotatably mounted relative to the connector housing, the lever having lever arms and a lever handle, the lever arms extending from the side walls of the housing, the lever handle extending between the lever arms; and a wire guide positioned on the lever;

wherein the lever is rotatable between a pre-insertion position and an insertion position; and wherein when the lever is in the insertion position, the wire guide engages the wires which extend from the housing to direct the wires to a designated position.

2. The electrical connector as recited in claim 1, wherein the wire guide extends from the lever handle.

3. The electrical connector as recited in claim 1, wherein the wire guide extends between the lever arms.

4. The electrical connector as recited in claim 1, wherein the wire guide and the lever are integrally molded in one piece.

5. The electrical connector as recited in claim 1, wherein the wire guide has a wire receiving cavity which cooperates with the wires as the lever is rotated from the pre-insertion position to the insertion position.

6. The electrical connector as recited in claim 1, wherein the wire guide has a wire engaging surface which cooperates with the wires as the lever is rotated from the pre-insertion position to the insertion position.

7. The electrical connector as recited in claim 6, wherein the wire engaging surface extends at an angle of between approximately 45 degrees and 90 degrees relative to a mating surface of the housing.

8. The electrical connector as recited in claim 1, wherein the lever arms have shaft receiving openings provided proximate free ends of the lever arms, the shaft receiving openings receiving stub shafts which extend from side walls of the housing.

9. The electrical connector as recited in claim 1, wherein the lever arms have pinions provided at free ends of the lever arms, the pinions being configured to cooperate with projections of a mating connector.

10. The electrical connector as recited in claim 1, wherein the lever has a locking projection which cooperates with a locking opening on the housing to prevent the unwanted movement of the lever when the lever is in the insertion position.

11. The electrical connector as recited in claim 10, wherein the locking projection is positioned on the lever handle.

12. An electrical connector comprising:

a connector housing having a first wall, a second wall and side walls extending between the first wall and the second wall;

multiple contacts positioned in contact receiving cavities of the housing, the multiple contacts having wires extending therefrom;

lever engaging projections extending from the side walls;

a lever rotatably mounted relative to the connector housing, the lever having lever arms and a lever handle, the lever arms extending from the side walls of the housing, the lever handle extending between the lever arms, the lever arms having projection receiving openings which engage the lever engaging projections;

a wire guide positioned on the lever, the wire guide having a wire engaging surface;

wherein as the lever is rotated about the lever engaging projections between a pre-insertion position and an insertion position, the wire engaging surface of the wire guide engages the wires which extend from the housing to direct the wires to a designated position.

13. The electrical connector as recited in claim 12, wherein the wire guide and the lever are integrally molded in one piece.

14. The electrical connector as recited in claim 13, wherein the wire guide extends between the lever arms.

15. The electrical connector as recited in claim 14, wherein the wire engaging surface of the wire guide is positioned in a wire receiving cavity.

16. The electrical connector as recited in claim 13, wherein the wire engaging surface extends at an angle of between approximately 45 degrees and 90 degrees relative to a mating surface of the housing.

17. The electrical connector as recited in claim 16, wherein the lever arms have pinions provided at free ends of the lever arms, and the pinions are configured to cooperate with projections of a mating connector.

18. The electrical connector as recited in claim 16, wherein the lever has a locking projection which cooperates with a locking opening on the housing to prevent the unwanted movement of the lever when the lever is in the insertion position.

19. The electrical connector as recited in claim 18, wherein the locking projection is positioned on the lever handle.

20. An electrical connector comprising:

a connector housing having a first wall, a second wall and side walls extending between the first wall and the second wall;

multiple contacts positioned in one or more contact receiving cavities of the connector housing, one or more of the multiple contacts having wires extending therefrom;

a one piece lever and wire guide member comprising:

a lever portion rotatably mounted relative to the connector housing, the lever portion having lever arms and a lever handle, the lever arms extending from the side walls of the housing, the lever handle extending between the lever arms; and a wire guide portion positioned on the lever portion, the wire guide portion having a wire engaging surface;

wherein as the one piece lever and wire guide member is rotated between a first position and a second position, the wire engaging surface of the wire guide portion engages the wires which extend from the housing to direct the wires to a designated position.

* * * * *